US007134620B1

(12) United States Patent
Lee

(10) Patent No.: US 7,134,620 B1
(45) Date of Patent: Nov. 14, 2006

(54) ELECTRIC ICE PLANER

(76) Inventor: Ming-Tsung Lee, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/305,151

(22) Filed: Dec. 19, 2005

(51) Int. Cl.
*B02C 23/00* (2006.01)

(52) U.S. Cl. ..... 241/37.5; 241/DIG. 7

(58) Field of Classification Search ..... 241/37.5, 241/DIG. 7, 92; D7/374
See application file for complete search history.

(56) References Cited

U.S. PATENT DOCUMENTS 5,007,591 A * 4/1991 Daniels, Jr. ..... 241/37.5

6,012,660 A * 1/2000 Colman ..... 241/30

* cited by examiner

*Primary Examiner*—Faye Francis

(57) ABSTRACT

An electric ice planer includes a bottom base, a frame base, a transmitting mechanism, a stationary cap, a lift cap, a plane base, a fit cylinder, and an ice container. The transmitting mechanism rotates the ice container, so small ice blocks placed in the ice container may be guided to move on a helical guide member in the ice container to a plan of the plane base and then planed into small bits of ice and then drops down into a container on a receptive surface of the bottom base below the plane base for use. So the electric ice planer saves time and labor, not wasting ice blocks and simple to assemble and disassemble for convenience of washing and cleaning.

4 Claims, 7 Drawing Sheets

ELECTRIC ICE PLANER

BACKGROUND OF THE INVENTION

1. Field of the Invention

This invention relates to an electric ice planer, particularly to one provided with a transmitting mechanism for rotating an ice container so as to let small blocks of ice guided by an ice guide member to move to a plane so that the small ice blocks may be planed to become very small bits of ice. The ice planing saves time, labor, not wasting ice blocks and facilitating disassembling, washing and cleaning.

2. Description of the Prior Art

Conventional ice planers are generally manually moved for ice blocks placed in an ice planer to be planed to become comparatively small bits of ice for use, and ice blocks have to be selected for suiting the size of an ice holder for putting them in the ice planer.

Then a large ice block is pressed by a pressing member with sharp teeth on the bottom tightly pressing it, with the bottom of the ice block contacting an upper surface of the container. Then a swinging rod is rotated to force the pressing member rotate so that the ice block on the container may also rotate and be planed by the plane on the upper surface of the container to become small bits of ice and fall down in a container below the ice container. Then the small bits of ice received in the container can be used.

However, the conventional ice planer requires not a little time and labor, and moreover, an ice block may not be planed totally, leaving a small dimension impossible to be planed and to be discarded, making up some waste, and in addition, it needs rather a large block of ice instead of small blocks.

SUMMARY OF THE INVENTION

This invention has been devised to offer an electric ice planer possible to save time and labor, and simple for assembling and disassembling so as to facilitate it for washing and cleaning.

The feature of the invention is a bottom base provided with a receptive surface and an insert hole; a frame base combined on the bottom base and provided with an insert rod, a hollow space, an opening, an engage groove in a wall defining the opening, and a switch fixed on a sidewall; a transmitting mechanism installed in the hollow space of the frame base and composed of a motor, a worm as the shaft of the motor, a worm gear engaging the worm, and a gear engaging the worm gear; a stationary cap placed on the frame base, and provided with an opening corresponding to the opening of the frame base, an annular stop edge in the wall defining the opening, a notch in the stop edge, a hole in the wall of the opening, a recess, a groove in the recess and extending down to the bottom; a lift cap pivotally connected with the stationary cap and provided with a pivotal base at one side; a plane base vertically installed in the opening of the cap, and having a center hollow space, two slits in the bottom, a plane fitted in the slits, a central shaft in the hollow space, a stop edge in an upper end, a notch in the stop edge, a position block on the underside, an annular subordinate gear on the stop edge and engaging the gear of the transmitting mechanism, and the subordinate gear having plural fit grooves; an ice container installed in the hollow space of the plane base, and provided with a hollow space for ice, a shaft sleeve in the hollow space, a helical guide member in the hollow space for guiding ice blocks, an opening formed between the start point and the end point of the helical guide member, a flange in an upper end, plural insert blocks on the underside of the flange, and a rotatable button fitting with the top of the shaft sleeve of the ice container.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
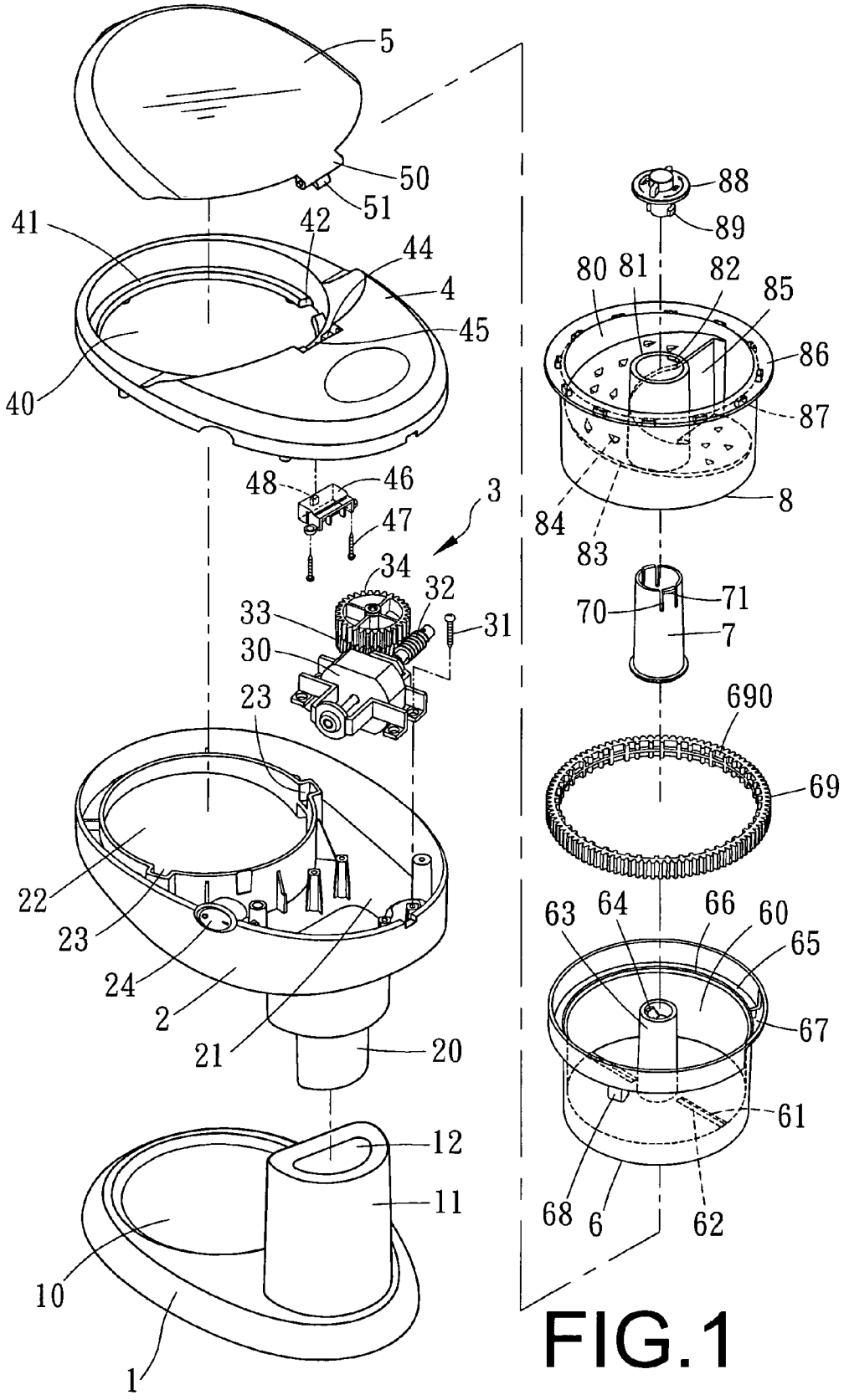
FIG. 1 is an exploded perspective view of an electric ice planer in the present invention.
Figure 2:
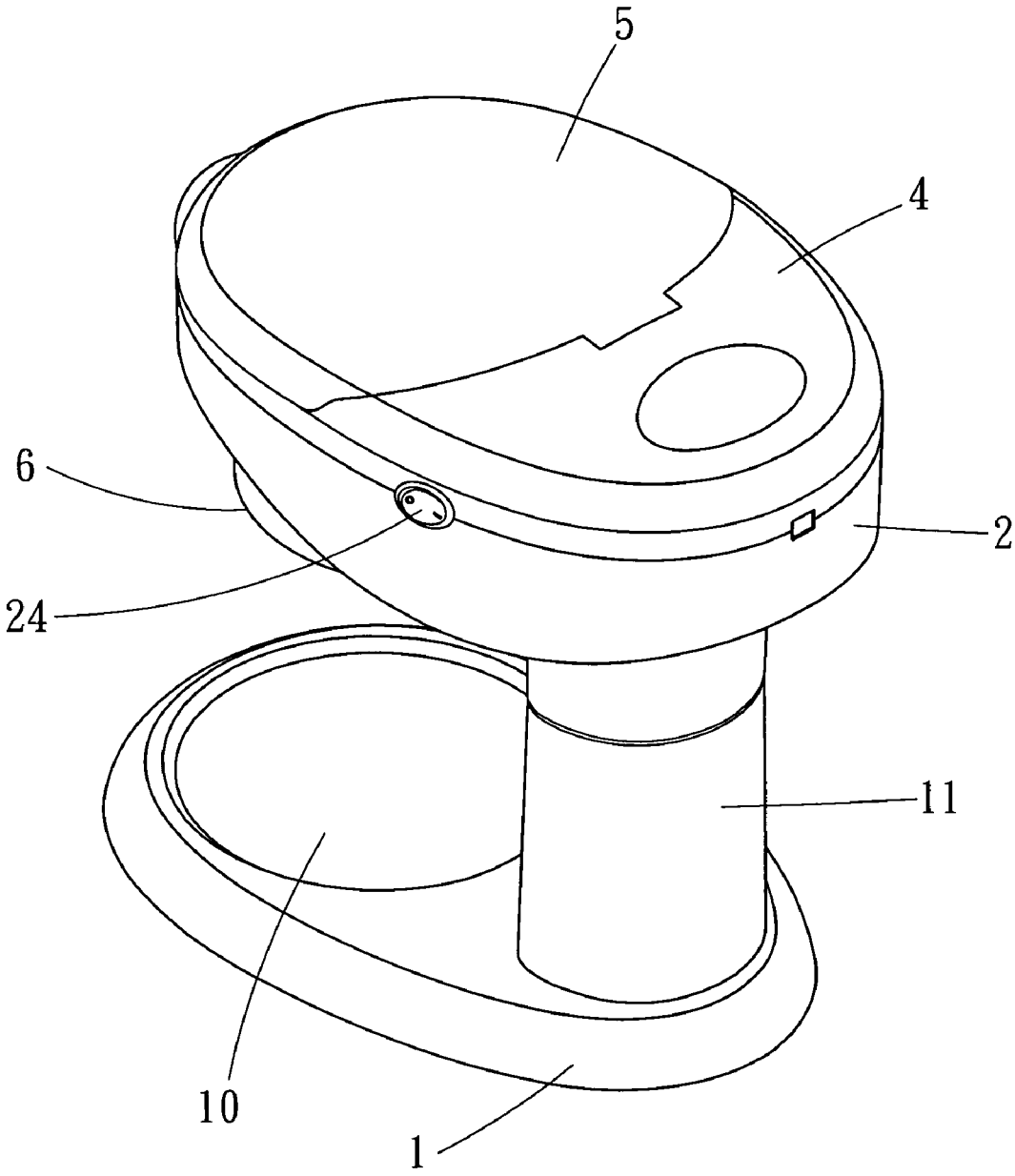
FIG. 2 is a perspective view of the electric ice planer in the present invention.
Figure 3:
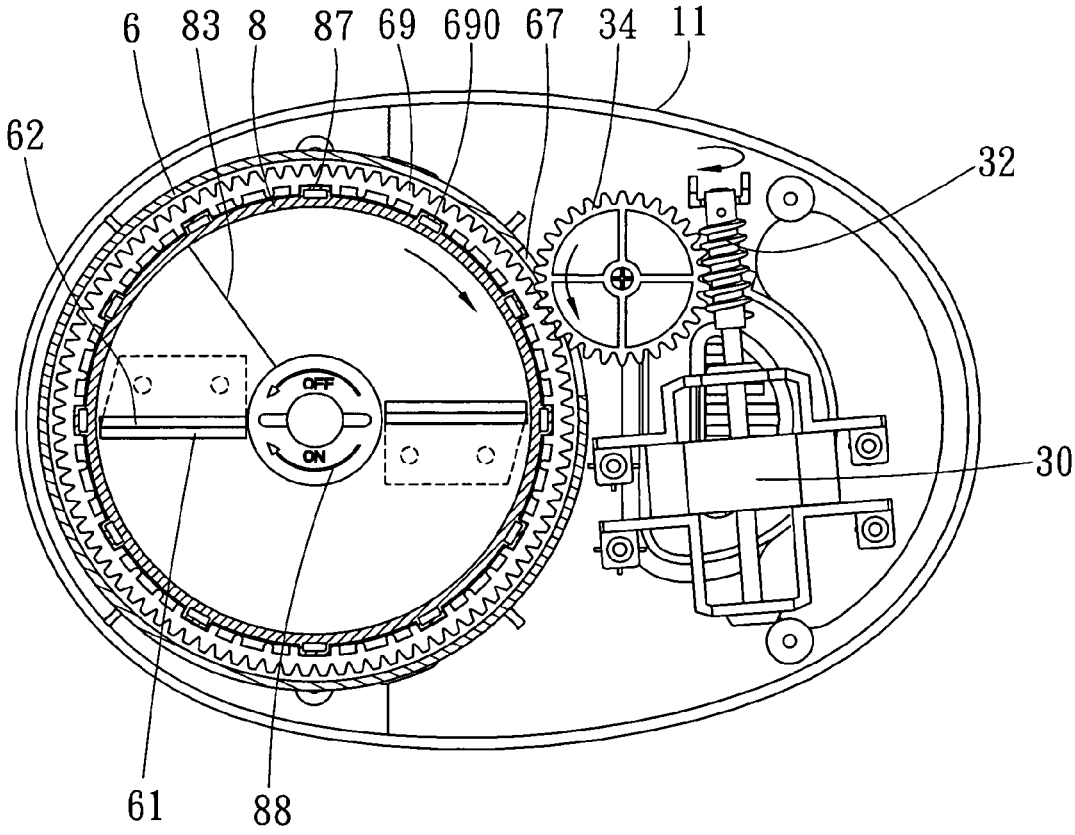
FIG. 3 is a cross-sectional view of the electric ice planer in the present invention.

A preferred embodiment of an electric ice planer in the present invention, as shown in FIGS. 1, 2 and 3, includes a bottom base 1, a frame base 2, a transmitting mechanism 3, a stationary cap 4, a lift cap 5, a plane base 6, a fit cylinder 7, and an ice container 8 as main components.

The bottom base 1 is provided with a receptive surface 10 for placing a container, an insert post 11 and an insert hole 12 formed vertically in the insert post 11.

The frame base 2 is combined on the bottom base 1, having an insert rod 20 formed in the bottom to fit in the insert hole 12, a hollow space 21 formed in an upper portion, an opening 22 formed in a front half portion and beside the hollow space 21, an engage groove 23 formed in a wall defining the opening 22, and a switch 24 fixed in and half exposed out of a wall.

The transmitting mechanism 3 is installed in the hollow space 21 of the frame base 2, composed of a motor 30 fixed in the hollow space 21 with fasteners 31, a worm 32 formed as the shaft of the motor 30, a worm gear 33 engaging the worm 32, and an gear 34 engaging the worm gear 33.

Figure 7:
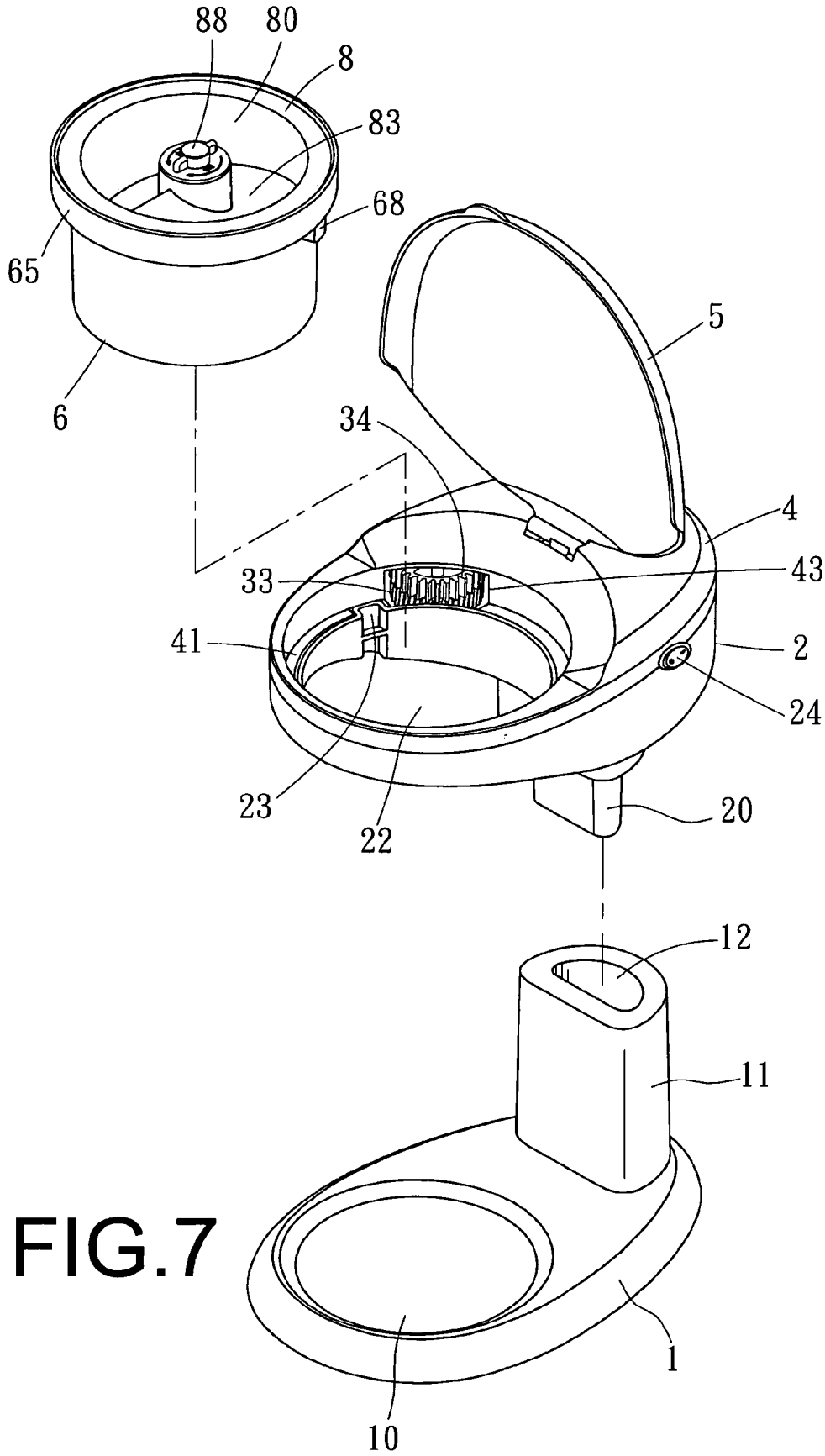

The stationary cap 4 is combined immovable on an upper surface of the frame base 2, having an opening 40 corresponding to the opening 22 of the frame base 2, a stop edge 41 annually formed in the wall defining the opening 40, a notch 42 formed in the stop edge 41, an hole 43 in the wall defining the opening 40 on the stop edge 41 as shown in FIG. 7, a recess 44 and a groove 45 in the recess extending from the top to the bottom. Further, a micro switch 46 fixed on the bottom of the stationary cap 4, having a contact projection 48.

The lift cap 5 is pivotally connected with the cap 4 in the opening 40, preferably made as transparent, having a pivotal base 50 extending out from one side, and the pivotal base 50 provided with a projection 51.

The plane base 6 is installed in the opening 22 of the frame base 2 and the opening 40 of the stationary cap 4, having a hollow space 60 in the interior, two slits 61 aligned in a bottom surface, a plane 62 fitted in the two slits 61, a center upright shaft 63 in the hollow space 60, a fit block 64 in the upright shaft 63, a stop edge 65 in an upper end, an annular projection 66 in the stop edge 65, a notch 67 also in the stop edge 65, and a position block 68 under the stop edge 65. Further, a subordinate gear 69 is installed on the stop edge 65, engaging the gear 34 of the transmitting mechanism 3, having plural fit grooves 690 in an inner surface.

The fit cylinder 7 fits around the upright shaft 63 of the plane base 6, having plural slits 71 in an upper end and a projection 71 between two slits 70.

The ice container 8 is placed in the hollow space 60 of the plane base 6, having a hollow space 80, a shaft sleeve 81 in the hollow space 80 to fit around the fit cylinder 71, an insert hole 82 in the shaft sleeve 81, a helical guide member 83 in the hollow space 80, plural sharp teeth 84 spaced apart on the surface of the helical guide member 83, an opening 85 formed between a start point and an end point of the helical guide member 83, a flange 86 on an upper end, plural insert blocks 87 formed on the underside of the flange 86, a rotatable button 88 fitted on top of the shaft sleeve 81 and having a downward fit block 89.

In assembling, referring to FIGS. 1–4, firstly, the insert rod 20 of the frame base 2 is inserted in the insert hole 12 of the insert post 11 of the bottom base 1 to combine the frame base 2 on the bottom base 1. Then the transmitting mechanism 3 is fixed in the hollow space 21 of the frame base 2, and the micro switch 46 is fixed on the underside of the stationary cap 4 with the fasteners 31, with the contact projection 48 extending in the groove 45 of the stationary cap 4. Next, the stationary cap 4 is fixed on the frame base 2, with the gear 34 of the transmitting mechanism 3 positioned on the opening 43 of the stationary cap 4, and with the notch 42 of the stationary cap 4 engaging the engage groove 23. Then the pivotal base 50 of the lift cap 5 is pivotally connected in the recess 44 of the stationary cap 4, enabling the lift cap 5 may be swung up and down on the opening 40 of the stationary cap 4. So the projection 51 of the lift cap 5 presses the contact projection 48 of the micro switch 46. Further, the subordinate gear 69 is placed on the stop edge 65 of the plane base 6, and the fit cylinder 7 is put around the central shaft 63 of the plane base 6, with the ice container 8 placed in the hollow space 60 of the plane base 6 and with the shaft sleeve 81 of the ice container 8 fitting around the fit cylinder 7 and with the projection 71 of the fit cylinder 7 fitting in the insert hole 82 of the shaft sleeve 81. Further, the insert blocks 87 of the flange 86 of the ice container 8 is made to fit in the insert grooves 690 of the subordinate gear 69, and the rotatable button 88 is pushed in the shaft sleeve 81, and then rotated for an angle, letting the fit block 89 fit with the insert block 64 in the central shaft 63 stably. Thus the plane base 6 is combined with the ice container 8.

Next, the combined entity of the plane base 6 together with the ice container 8 is placed in the hollow spaces 40 and 22 of the cap 4 and the frame base 2, with the stop edge 65 of the plane base 6 located just on the stop edge 41 of the stationary cap 4, and with the position block 68 of the plane base 6 inserted in the engage groove 23 of the frame base 2 for arresting the plane base 6 immovable. Then the subordinate gear 69 engages the gear 34 just in the opening 40 of the stationary cap 4.

Figure 4:
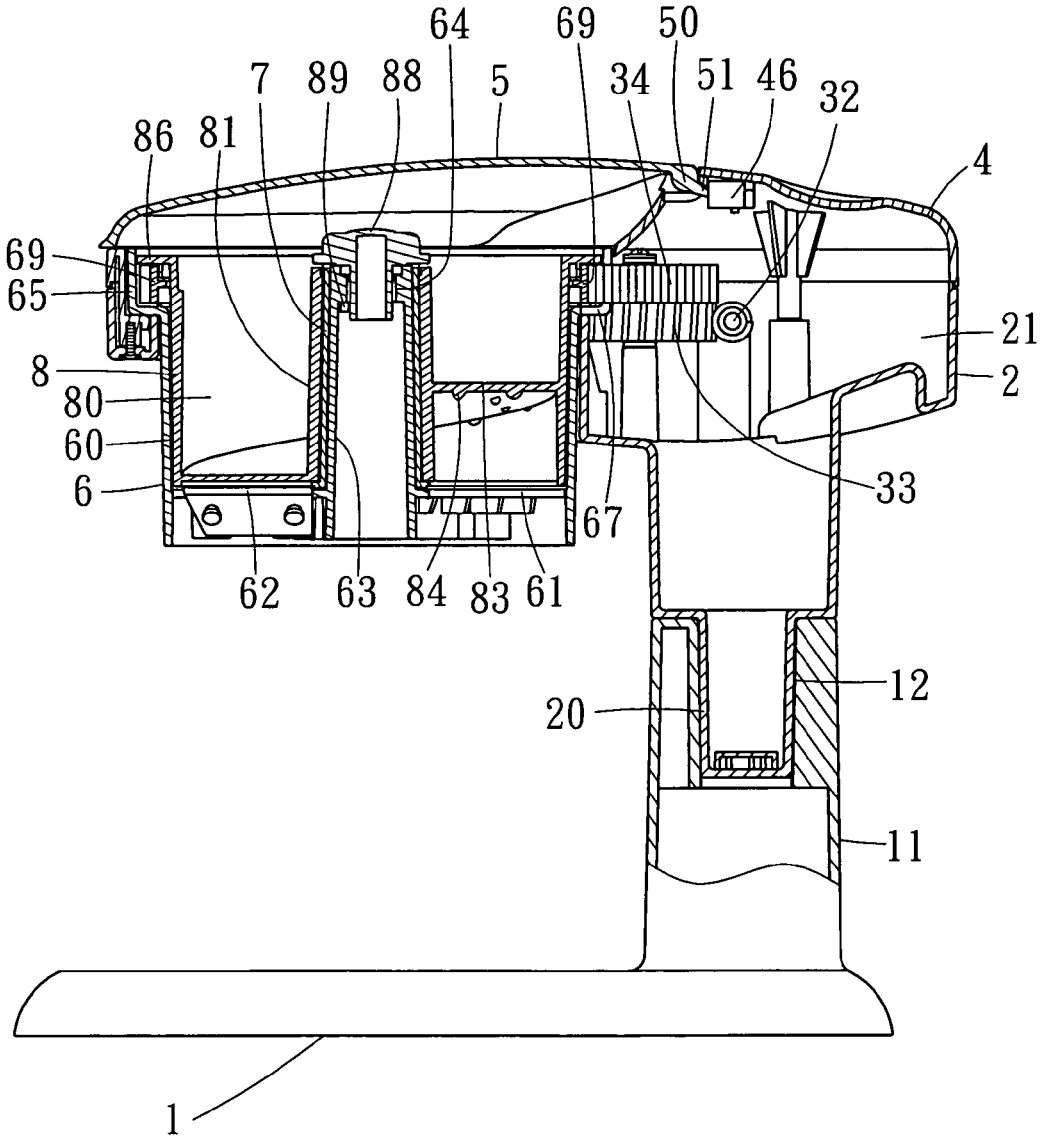
FIG. 4 is an upper view of a transmitting mechanism in the present invention.
Figure 5:
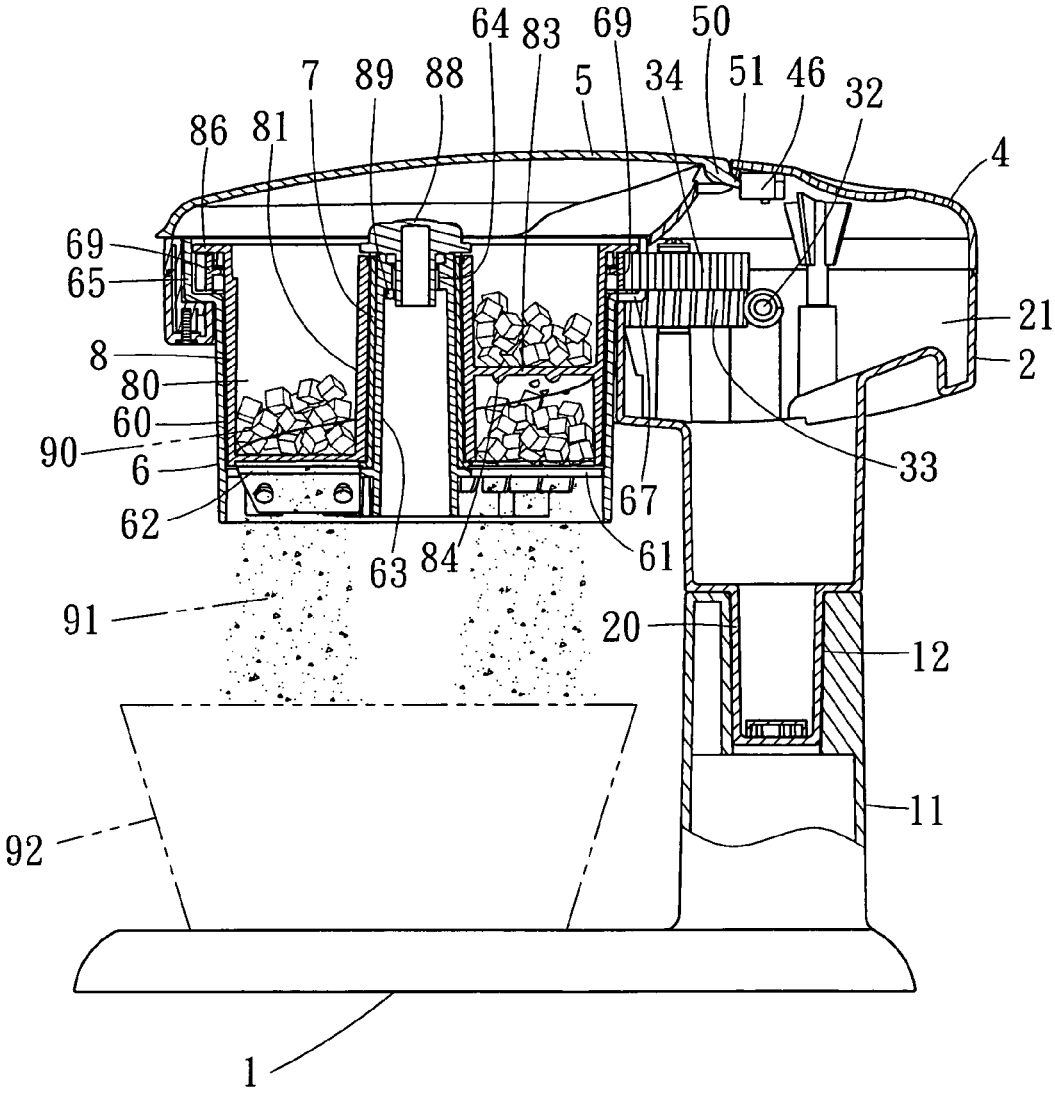
FIG. 5 is a cross-sectional view of the electric ice planer in the present invention, showing it under an ice planing condition with a lift cap closed.
Figure 6:
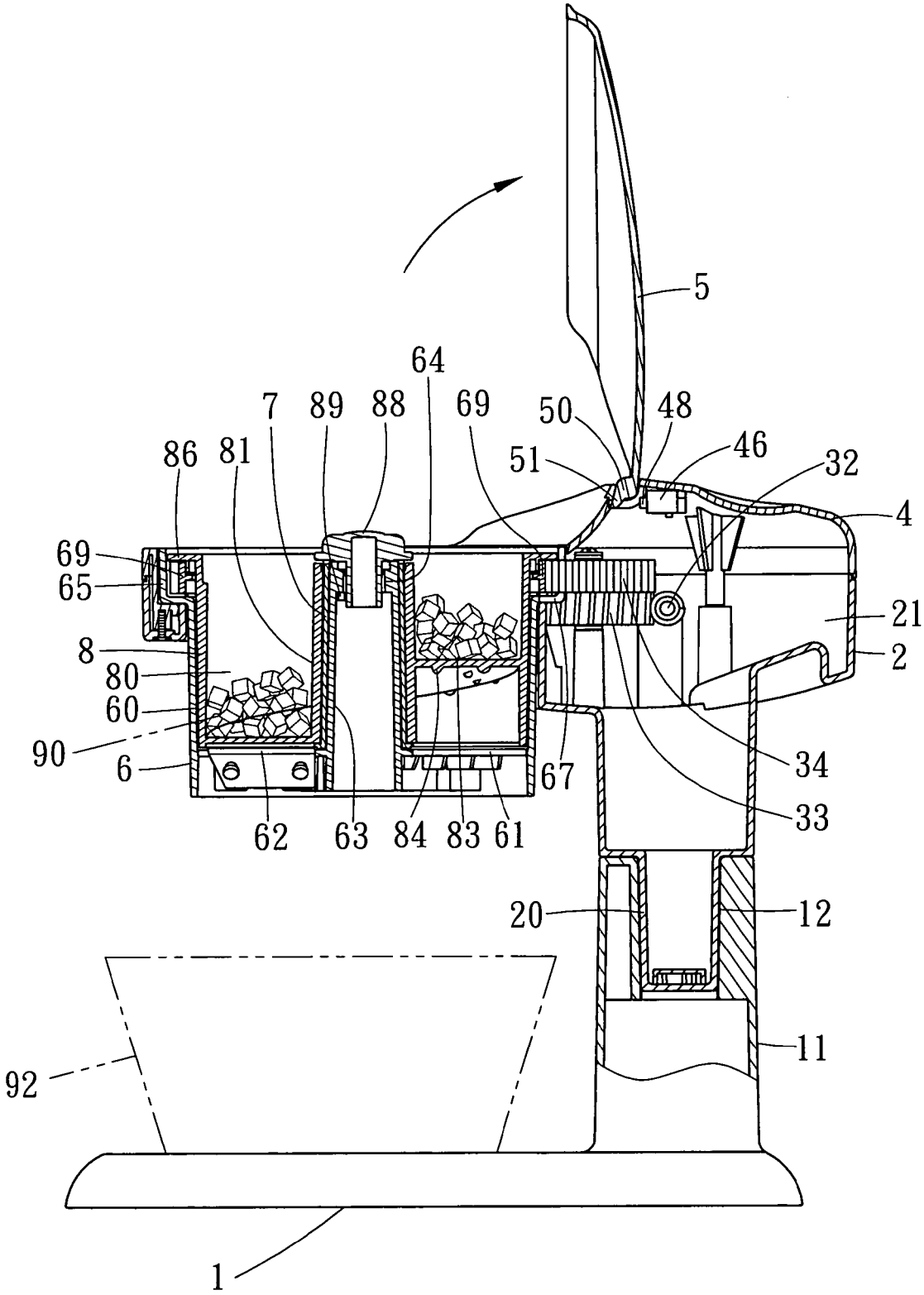
FIG. 6 is a cross-sectional view of the electric ice planer in the present invention, showing it under a turned-off condition with the lift cap swung open; and, FIG. 7 is a perspective view of the electric ice planer in the present invention, showing it under a disassembled condition for cleaning.

Next, in using, referring to FIGS. 4, 5 and 6, at first the lift cap 5 is swung up, and small ice blocks 90 are placed into the hollow space 89 of the ice container 8, and then the lift cap is swung down and closed up the opening 40. Then the switch 24 is turned on to begin planing ice, staring the motor 30 to rotate the worm 32, which then rotates the worm gear 33, and the worm gear 33 transmits rotation to the gear 34, which then rotates the subordinate gear 69, so the ice container 8 may be rotated, with the ice blocks 90 in the hollow space 80 moving with the helical guide member 83 through the opening 85 into the hollow space 60 of the plane base 6 below the helical guide member 83. The small ice blocks 90 are tightly held by the sharp teeth 84 of the helical guide member 83, not sliding around during helical movement on the guide member 83, gradually passing the plane 62 of the hollow space 60 of the plane base 6 and planed into small bits of ice 91 to drop down through the grooves 61 into the container 92 placed on the receptive surface 10 of the bottom base 1. Then the small bits of ice 91 can be used.

After the small ice blocks 90 in the ice container 8 are used up, the lift cap 5 is swung up, with the projection 51 no longer pressing the contact projection 48 of the micro switch 46 to cut off power. Then the motor 30 does not operate any more, and then small ice blocks 90 can be added in the ice container 8 again, with the lift cap 5 closed down again for next round of planing work. Thus, this electric ice planer is extremely safe to use, and convenient to handle. Moreover, the small ice blocks 90 can never be wasted, possible to be planed completely.

If the electric ice planer is needed to be washed and cleaned, as shown in FIG. 7, only swing up the lift cap 5, and pull up the combined entity of the plane base 6 together with the ice container 8 from the hollow space 40 of the stationary cap 4. Next, turn the rotatable button 88 counterclockwise, forcing the engage projection 89 separate from the insert block 64 of the plane base 6. Then the ice container 8, the fit cylinder 7 and the plane base 6 can be disassembled from each other and washed cleanly, and the bottom base 1 is pulled off the frame base 2, the two components 1 and 2 are ready for washing and cleaning. Quite simple.

The invention has the following advantages, as can be seen from the foresaid description.

1. It can use small ice blocks for planing, needless to make a large ice block purposely.

2. It can be moved automatically without manual work, saving time and labor.

3. It can completely plane small ice blocks, wasting no ice blocks.

4. It is simple to assemble and disassemble, so convenient for washing and cleaning.

While the preferred embodiment of the invention has been described above, it will be recognized and understood that various modifications may be made therein and the appended claims are intended to cover all such modifications that may fall within the spirit and scope of the invention.

What is claimed is:

1. An electric ice planer comprising:

a bottom base provided with a receptive surface and an insert post with an insert hole;

a frame base combined on said bottom base and provided with an insert rod to fit in said insert hole of said insert post of said bottom base, a hollow space, an opening beside said hollow space, and an insert groove formed in a wall defining said opening, and a switch fixed on a sidewall of said frame base;

a transmitting mechanism installed in said hollow space of said frame base, said transmitting mechanism composed of a motor, a worm formed as a shaft of said motor, a worm gear engaging said worm, and a gear engaging with said worm gear;

a stationary cap combined on an upper surface of said frame base, said stationary cap provided with an opening corresponding to said opening of said frame base, an annular stop edge formed in an annular wall defining said opening, said stop edge having a notch, said wall defining said opening provided with a hole, said cap further provided with a recess and a groove formed in said recess and extending down to a bottom, a micro switch fixed on an underside of said stationary cap;

a lift cap pivotally connected on said opening of said cap and having a side provided with a pivotal base, said pivotal base having a projection on an outer wall;

a plane base positioned vertically in said opening of said cap and having a hollow space, two slits formed in a straight line in a bottom wall of said hollow space, a plane fitted in said slits of said bottom wall, a central shaft provided in said hollow space, said plane base further having an annular stop edge in an upper section, a notch formed in a sidewall of said stop edge, a position block fixed under said stop edge, an annular subordinate gear put on said stop edge and engaging said gear of said transmitting mechanism, said subordinate gear having plural insert grooves; and, an ice container installed in said hollow space of said plane base and having a hollow space, a shaft sleeve formed vertically in said hollow space, said hollow space having a helical guide member, an vertical opening formed between a start point of said helical guide member and an end point of said helical guide member, said ice container further having a flange on an upper end, said flange having plural insert blocks on its underside, and a rotatable button provided to insert in a top of said shaft sleeve of said ice container.

2. The electric ice planer as claimed in claim 1, wherein said plane base has a fit cylinder fitting around said center shaft, said fit cylinder is provided with plural slits in an upper annular end, a projection formed between said slits, said shaft sleeve having an insert groove in an upper end, said center shaft of said plane base provided with an insert block, said rotatable button having an engage block on its bottom.

3. The electric ice planer as claimed in claim 1, wherein said helical guide member of said ice container is provided with plural sharp teeth on its bottom.

4. The electric ice planer as claimed in claim 1, wherein said stop edge of said plane base is provided with an annular protrusion.

* * * * *